US005890589A

United States Patent [19]

Lorens

[11] Patent Number: 5,890,589

[45] Date of Patent: Apr. 6, 1999

[54] COMPARTMENTALIZED TABLETOP ORGANIZER WITH DISPLAY POCKET

[76] Inventor: Stella Lorens, 760 Burr Oak Dr., Westmont, Ill. 60559

[21] Appl. No.: 379,181

[22] Filed: Jan. 27, 1995

[51] Int. Cl.[6] ..... B65D 69/00

[52] U.S. Cl. ..... 206/232; 206/457; 206/564; 40/312

[58] Field of Search ..... 206/232, 457, 206/561, 564; 220/408, 528, 553, 555, 662; 40/312

[56] References Cited

U.S. PATENT DOCUMENTS

| | | | |
|---|---|---|---|
| 4,575 | 3/1846 | Page . | |
| D. 311,456 | 10/1990 | Grossbart . | |
| 1,541,354 | 6/1925 | Harrison . | |
| 1,998,481 | 4/1935 | Yoder | 206/561 |
| 2,048,695 | 7/1936 | Hasenour . | |
| 2,731,996 | 1/1956 | Hayes | 220/553 |
| 2,834,130 | 5/1958 | Nelson | 40/312 |
| 3,258,017 | 6/1966 | Albert | 206/561 |
| 3,330,079 | 7/1967 | Mitchell et al. . | |
| 3,433,383 | 3/1969 | Phibbs | 220/553 |
| 3,737,093 | 6/1973 | Amberg et al. | 220/408 |
| 3,776,413 | 12/1973 | Myers | 220/408 |
| 3,874,977 | 4/1975 | Pyles . | |
| 4,047,633 | 9/1977 | Trombly . | |
| 4,991,712 | 2/1991 | Wagner | 206/561 |
| 5,009,018 | 4/1991 | Sebag . | |
| 5,439,108 | 8/1995 | Lackie | 220/528 |

*Primary Examiner*—David T. Fidel
*Attorney, Agent, or Firm*—Michael, Best, & Friedrich

[57] ABSTRACT

The present invention provides a tabletop organizer having compartments for the storage of various items such as condiments, jewelry, hardware and the like, and which also contains one or more display pockets integrated into the tabletop organizer where photographic, pictographic, or other types of graphic materials may be held and easily viewed.

18 Claims, 4 Drawing Sheets

COMPARTMENTALIZED TABLETOP ORGANIZER WITH DISPLAY POCKET

BACKGROUND OF THE INVENTION

1. Field of the Invention

This invention relates to organizers, and more particularly to compartmentalized tabletop organizers such as condiment holders and the like having an integrated display pocket.

2. Description of the Prior Art

The field of compartmentalized organizers is old and contains many examples of organizers made from various materials and for various purposes.

For example, U.S. Pat. No. 1,541,354, discloses a display box and sign holder for display of various goods which includes a mechanism for removing one entire wall of the display box to insert a printed display card.

U.S. Pat. No. 2,048,695, discloses a medicine glass rack which holds an individual medicine glass and includes means for holding a printed card at an angle such that a care-giver could readily see instructions, identification and like material on the card.

Other examples of art may include plastic or clear acrylic organizers for storage of jewelry, hardware and other items and are readily available in the marketplace to consumers and retailers alike. A similar example may be compartmentalized organizers for the storage of condiments, candies or other food related items. However, none of the prior organizers provide a compartmentalized tabletop organizer having an integrated display pocket for the display of photographic or pictographic material.

SUMMARY OF THE INVENTION

Accordingly, the present invention provides a tabletop organizer having compartments for the storage of various items such as condiments, jewelry, hardware and the like, and which also contains one or more display pockets integrated into the tabletop organizer where photographic, pictographic or other types of graphic materials may be held and easily viewed.

The organizer is made of a durable material such as acrylic or other type of plastic and the compartments can be made in various sizes depending upon the desired the use. The organizer can also be constructed from a composite of materials.

The display pockets are functionally integrated into the tabletop organizer by way of a double-walled construction located in each peripheral side of the organizer. This construction allows the item to be displayed by inserting the item between the walls of each peripheral side of the tabletop organizer. Appropriately, the outer wall of the tabletop organizer must be substantially clear to allow the displayed item to be visible through the outer wall.

Additionally, the compartments may be constructed to allow for the seating of removable compartments within the organizer.

Other features and advantages of the invention will become apparent to those of ordinary skill in the art upon review of the following detailed description, claims, and drawings.

Figure 1:
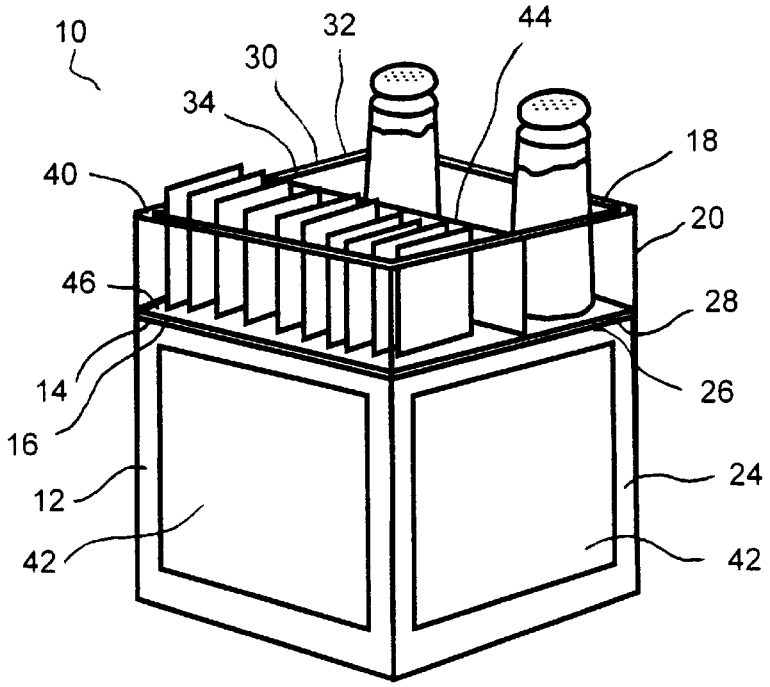
FIG. 1 is a front perspective view of a substantially box-shaped, two compartment tabletop organizer with display pocket.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENTS

As shown in FIG. 1 of the drawings, a compartmentalized tabletop organizer 10 with display pocket 40 is presented. FIG. 1 shows front side 12, back side 18, right side 24, and left side 30 of organizer 10. Bottom 36 of organizer 10 is not shown. The peripheral sides 12, 18, 24, and 30, and bottom 36 define the periphery of the organizer 10. Each peripheral side contains a mechanism whereby a graphic item 42 such as a photograph, pictograph or written card, may be displayed outwardly from the tabletop organizer 10 such that the graphic item 42 can be readily viewed by an observer. In a preferred embodiment, each peripheral side 12, 18, 24, and 30 consists of two substantially parallel walls 14 and 16 having display pocket 40 wherein a photograph or other type of prepared graphic item 42 may be inserted between the walls providing a display of the graphic item 42. In a preferred embodiment as shown in FIG. 1, front wall 14 and front inner wall 16, back wall 20 and back inner wall 22, right side wall 26 and right inner wall 28, and left side wall 32 and left inner wall 34 are provided for the insertion of a graphic item 42 into display pocket 40. Two graphic items 42 are shown and are visible through front wall 14 and right side wall 26, respectively. Display pocket 40 is shown located at a top end of front side 12 and 24, although the display pocket 40 may be located in other appropriate locations, such as along a lateral edge, in other embodiments. Compartment divider 44 is shown in this preferred embodiment connected to platform 46. However, other embodiments may not contain platform 46, but may instead utilize bottom 36 as support for any items stored in the compartments. Compartment divider 44 is shown creating two compartments for this preferred embodiment, however, compartment dividers creating three or more compartments are contemplated in other preferred embodiments.

The entire organizer 10 is preferably made of a durable material such as thermoplastic or polymeric resins. Examples of such materials include: acrylic resins, cellulosic resins, ceramic fiber compounds, fluoroplastic resins, polyamide resins, polycarbonate resins, phenolic resins, polyethelene resins, polyester resins, polymethylpentene resins, polyoxymethylene resins, polyphenylene resins, polypropylene resins, polystyrene resins, polyvinyl resins, nitrile resins, terephthalic resins, or glass fiber compounds. However, other types of plastics and polymeric materials known to those in the art may be used provided that an outer wall such as front wall 14 which contains the display pocket 40 is constructed to allow the graphic item 42 to be visible through the material. Additionally, the tabletop organizer 10 may be constructed from composite materials. Examples of materials which can be used in such composites along with the above named plastics and polymers are aramid fiber, carbon fiber, cellulosic fiber, ceramic fiber, glass fiber, metallic fiber, and thermoplastic fiber. Of course, other functionally similar materials are contemplated as being within the scope of the present invention.

Figure 2:
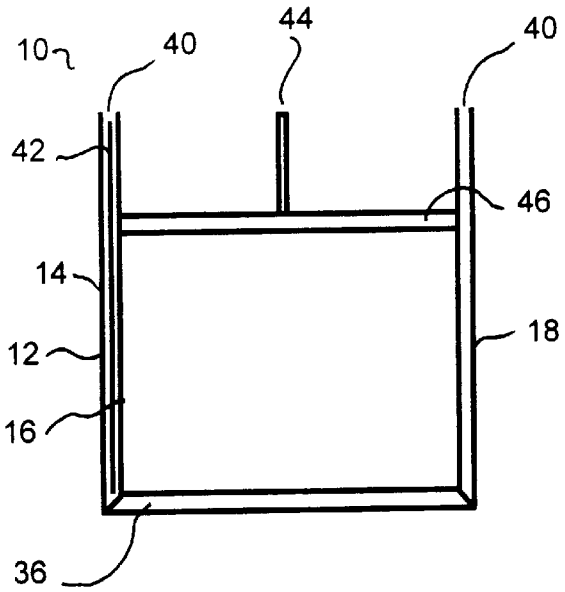
FIG. 2 is a cross-sectional view taken along line x—x of the two compartment tabletop organizer with display pocket of FIG. 1.

FIG. 2 is a cross-sectional view of the tabletop organizer 10 with display pocket 40 in FIG. 1. FIG. 2 shows front side 12 and back side 18 connected to platform 46. FIG. 2 also shows a two compartment embodiment of the tabletop organizer 10. Compartment divider 44 is shown attached to platform 46. This embodiment may be particularly useful where a smaller organizer is desired. In other preferred embodiments where platform 46 is not utilized, compartment divider 44 would be attached to bottom 36. Graphic item 42 is shown in cross section placed in display pocket 40 between front wall 14 and front inner wall 16.

Figure 3:
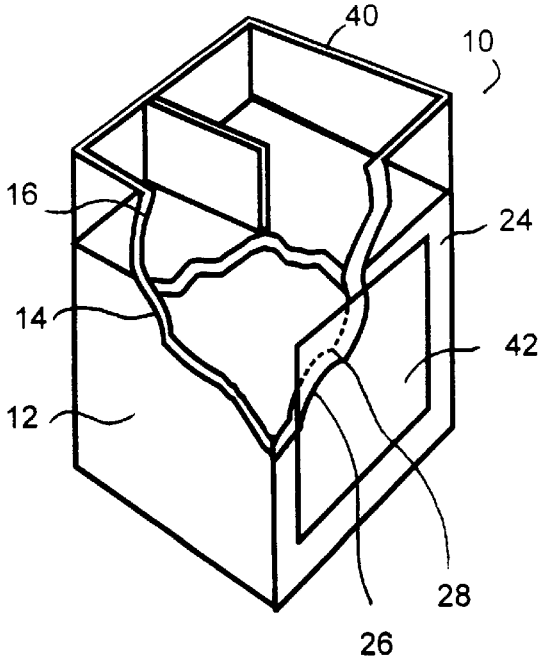
FIG. 3 is a cut-away sectional view of the two compartment tabletop organizer with display pocket of FIG. 1.

FIG. 3 is a cut-away sectional view of the tabletop organizer 10 with display pocket 40 in FIG. 1. FIG. 3 shows graphic item 42 inserted into display pocket 40 within front side 12 between front wall 14 and front inner wall 16. FIG. 3 also shows graphic item 42 inserted within right side 24 between right wall 26 and right inner wall 28.

Figure 4:
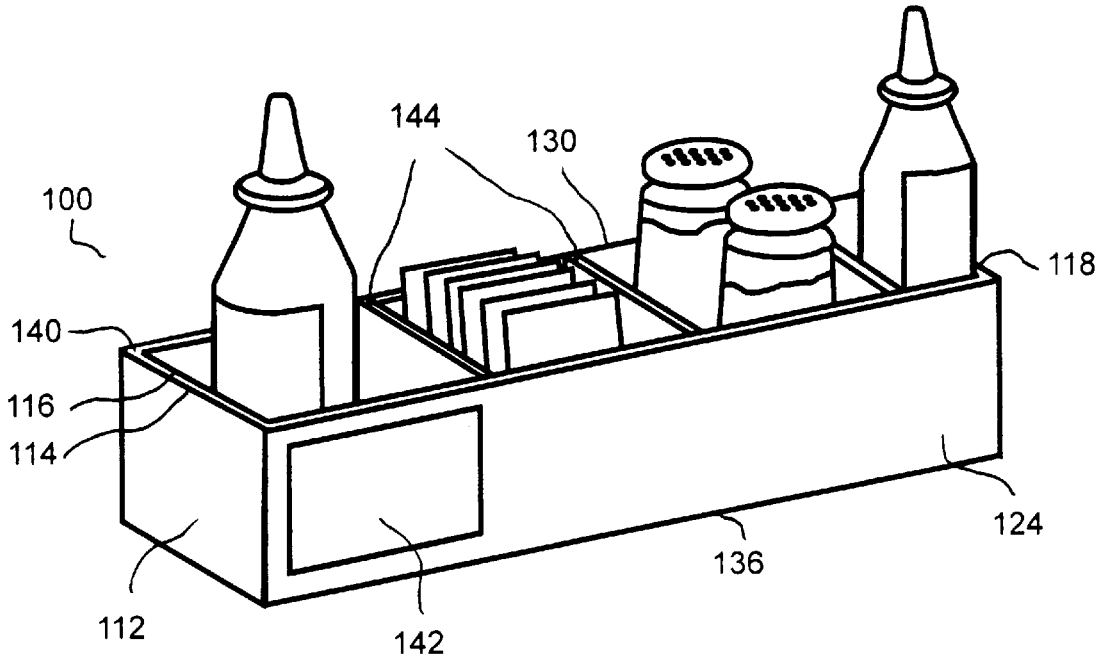
FIG. 4 is a front perspective view of an alternative preferred embodiment of an elongated tabletop organizer with display pocket having four compartments.

FIG. 4 is a perspective view of another preferred embodiment of an elongated, four compartment tabletop organizer 100 with display pocket 140. FIG. 4 also shows peripheral sides 112, 118, 124, and 130 consisting of two substantially parallel walls such as 114 and 116 having a display pocket 140 wherein a photograph or other type of prepared graphic item 142 may be inserted between the walls providing a display of the graphic item 142. In this embodiment, compartment divider 144 is connected to bottom 136 and provides the organizer 100 with four functional compartments. Organizer 100 is preferably constructed from durable thermoplastic or polymeric materials. The organizer 100 in FIG. 4 may be found to have particular utility when used for storage of condiments in a restaurant or other environments requiring an elongated tabletop organizer 100.

Figure 5:
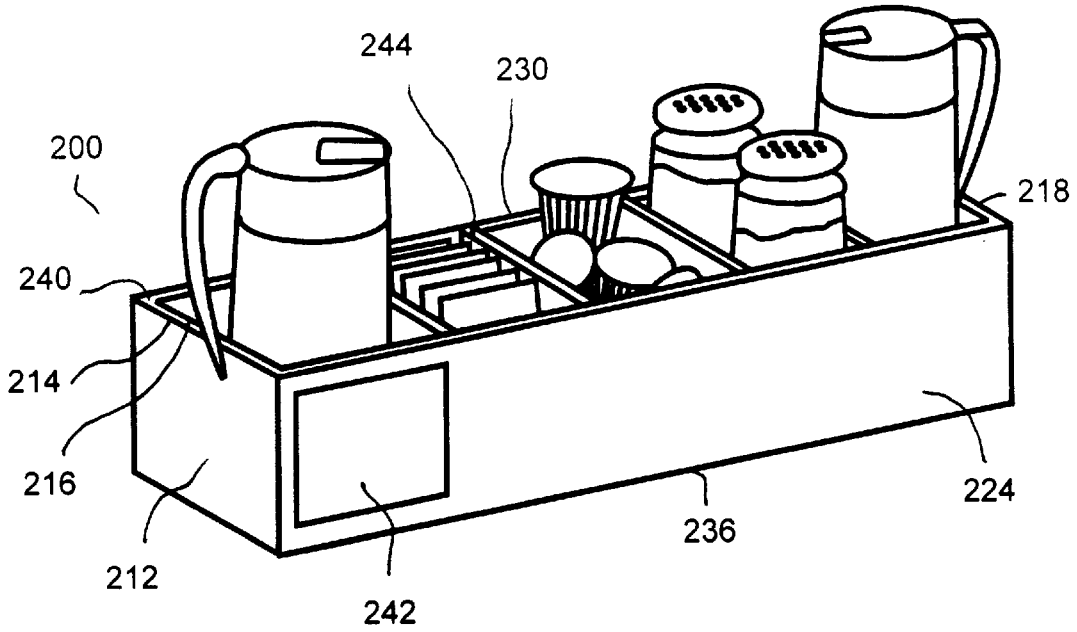
FIG. 5 is a front perspective view of an elongated, five compartment tabletop organizer with display pocket.

FIG. 5 is a perspective view of an elongated, five compartment tabletop organizer 200 with display pocket 240. FIG. 5 also shows peripheral sides 212, 218, 224, and 230 consisting of two substantially parallel walls such as 214 and 216 having a display pocket 240 wherein a photograph or other type of prepared graphic item 242 may be inserted between the walls allowing display of graphic item 242. In this embodiment, compartment divider 244 is connected to bottom 236 providing organizer 200 with five functional compartments. Accordingly, this embodiment is preferably constructed of durable thermoplastic on polymeric materials.

Figure 6:
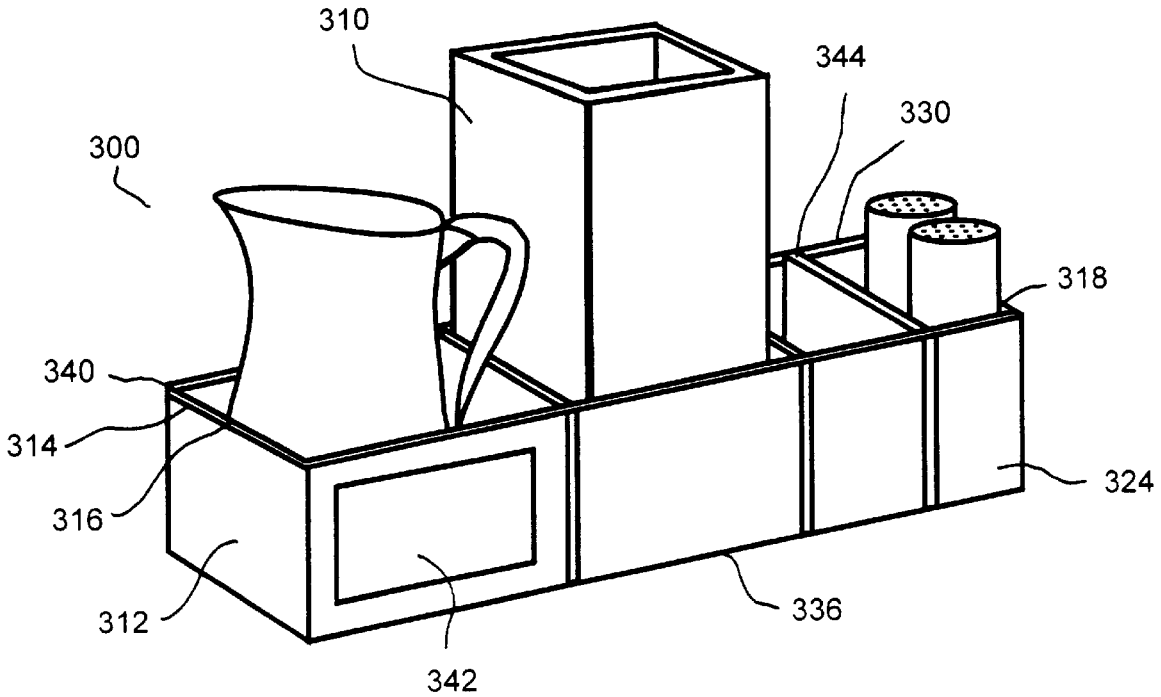
FIG. 6 is a front perspective view of an elongated, four compartment tabletop organizer with display pocket having one larger, removable compartment.

FIG. 6 is a perspective view of an elongated, four compartment tabletop organizer 300 with display pocket 340 having one larger, removable compartment 310. The peripheral sides 312, 318, 324, and 330 contain parallel walls such as 314 and 316 for insertion of a graphic item 342. The removable compartment 310 may also be constructed to have insertable peripheral sides and may be used for organizing longer items such as flowers, straws, pencils and the like, or may be used anywhere a taller compartment 310 is desired. In this embodiment, compartment divider 344 is connected to bottom 336 providing organizer 300 with four compartments. Here, one of the four is shown supporting a larger removable compartment 310. Organizer 300 is also preferably constructed from durable thermoplastic or polymeric materials.

Figure 7:
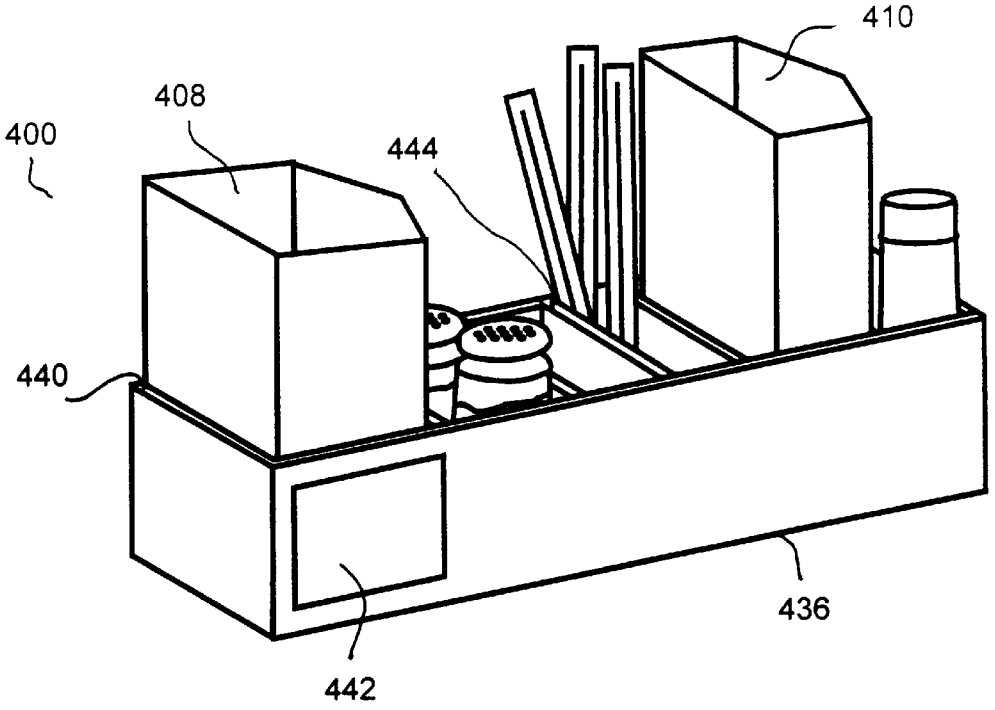
FIG. 7 is a front perspective view of an elongated, six compartment tabletop organizer with display pocket having two larger, removable compartments.

FIG. 7 is a perspective view of an elongated, six compartment tabletop organizer 400 with display pocket 440 having two larger, removable compartments 408 and 410. In this embodiment, divider 444 provides the organizer 400 with six compartments allowing the placement of two larger removable compartments within organizer 400. Divider 444 may be connected to bottom 436 or may be supported by attachment to the peripheral sides. Again, the removable compartments 408 and 410 as well as the tabletop organizer 400 may be constructed for insertion of a graphic item 442. In this embodiment, the two compartments 408 and 410 may be constructed to have planar peripheral sides or may be constructed to have a more curvilinear design such as juice pitchers or maple syrup containers. This embodiment might be particularly useful in a restaurant atmosphere or the like and is preferably constructed from durable thermoplastic or polymeric materials as referenced in FIG. 1.

Figure 8:
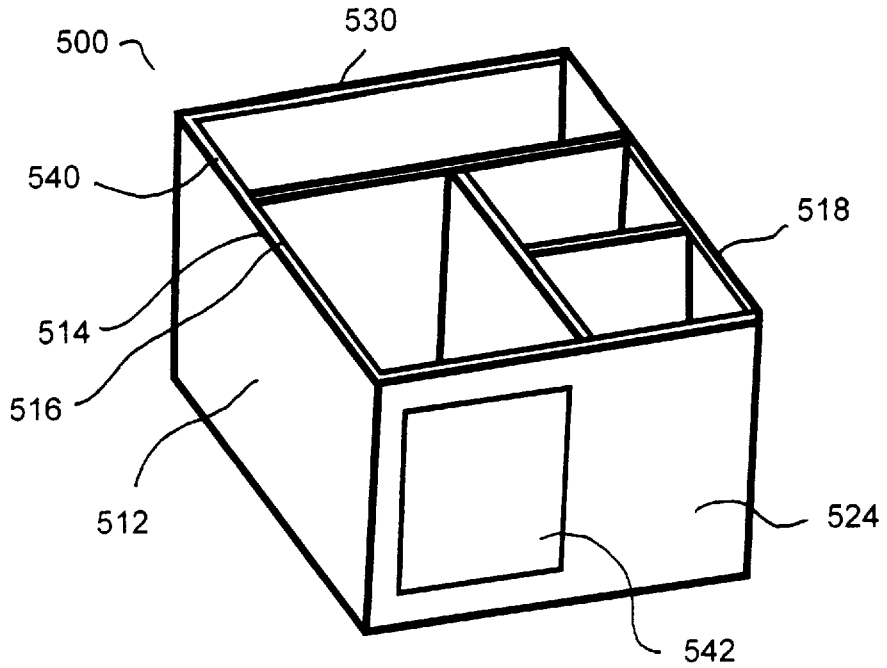
FIG. 8 is a front perspective view of a substantially box-shaped, four compartment tabletop organizer with display pocket.

FIG. 8 is a perspective view of a substantially box-shaped, four compartment tabletop organizer 500 with display pocket 540. FIG. 8 shows the tabletop organizer 500 having peripheral sides 512, 518, 524 and 530 which consist of two substantially parallel walls such as 514 and 516 having an opening wherein a photograph or other type of prepared graphic item 542 may be inserted between the walls providing a display of the item. This embodiment may be used similarly to the embodiment found in FIG. 1, although in situations where additional compartment space is necessary.

Figure 9:
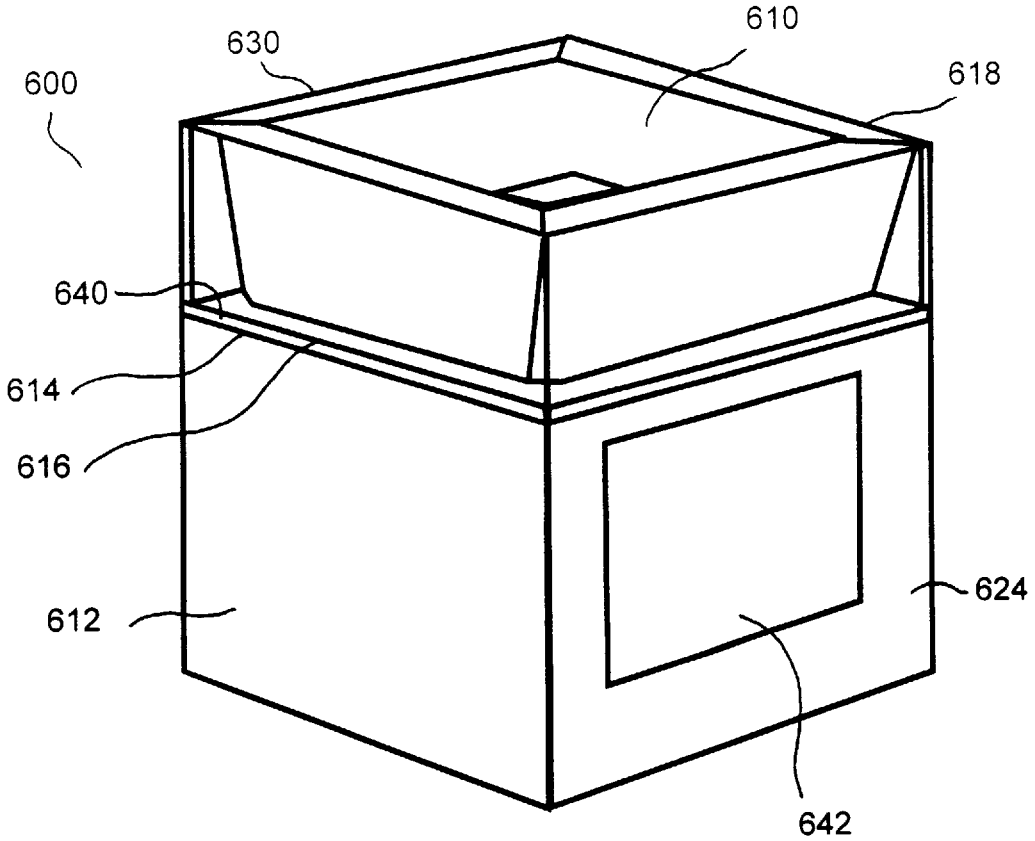
FIG. 9 is a front perspective view of a substantially box-shaped, one compartment tabletop organizer with display pocket.

FIG. 9 is a front perspective view of a substantially box-shaped, one compartment tabletop organizer 600 with display pocket 640. FIG. 9 shows the tabletop organizer 600 having peripheral sides 612, 618, 624 and 630 which consist of two substantially parallel walls such as 614 and 616 having an opening wherein a photograph or other type of prepared graphic item 642 may be inserted between the walls providing a display of the item. In this embodiment, there is a single compartment 610. Although the single compartment may be permanently attached in other embodiments, here the compartment 610 is shown as removable. The organizer 600 is preferably constructed of durable plastic or polymeric materials and may be advantageous where a single compartment is useful, such as for holding snack items or candies in a retail or restaurant atmosphere.

While a preferred embodiment of the invention has been described, by way of example, various modifications will become apparent to one of ordinary skill in the art. Thus, the scope of the invention is to be limited only by the spirit and scope of the following claims.

I claim:

1. A compartmentalized tabletop organizer comprising:

a substantially rectangular container having four peripheral sides and a bottom, the four peripheral sides and the bottom configured to define a compartment;

means contained within said peripheral sides for displaying a graphic item said means including an unsealed display pocket configured for insertion and removal of said graphic item into said unsealed display pocket;

a compartment divider disposed within said compartment defined by the peripheral sides and the bottom; and a removable compartment adapted to fit within said tabletop organizer.

2. The invention of claim 1 wherein the compartment divider is divided into three compartments.

3. The invention of claim 1 wherein the compartment divider is divided into four compartments.

4. The invention of claim 1 wherein the compartment divider is divided into five compartments.

5. The invention of claim 1 wherein the compartment divider is divided into six compartments.

6. The invention of claim 5 further including at least one additional removable compartment adapted to fit within the tabletop organizer.

7. The invention of claim 1 wherein the tabletop organizer is made from a substantially clear material.

8. The invention of claim 7 wherein the substantially clear material is constructed of light permeable plastic.

9. A compartmentalized tabletop organizer comprising:

a front side, said front side having a front wall and a front inner wall substantially parallel to said front wall, said front wall and said front inner wall defining a display pocket;

a back side opposed to said front side, said back side having a back wall and a back inner wall substantially parallel to said back wall, said back wall and said back inner wall defining a display pocket;

a right side disposed between said front side and said back side, and connected to said front side at a first end and said back side at a second end, wherein the right side is substantially at right angles to the front side and to the back side, the right side having a right wall and a right inner wall substantially parallel to the right wall, the right wall and the right inner wall defining a display pocket;

a left side opposed to said right side, and similarly disposed between said front side and said back side, and connected to said front side at a first end and said back side at a second end, wherein said left side is substantially at right angles to said front side and to said back side, said left side having a left wall and a left inner wall substantially parallel to said left wall, said left wall and said left inner wall defining a display pocket;

a bottom connected at substantially right angles to said front side, said back side, said right side and said left side wherein a compartment is defined;

at least one compartment divider within said compartment; and a removable compartment adapted to fit within said tabletop organizer.

10. The invention of claim 9 wherein the compartment divider is divided into three compartments.

11. The invention of claim 9 wherein the compartment divider is divided into four compartments.

12. The invention of claim 9 wherein the compartment divider is divided into five compartments.

13. The invention of claim 9 wherein the compartment divider is divided into six compartments.

14. The invention of claim 13 further including at least one additional removable compartment adapted to fit within the tabletop organizer.

15. The invention of claim 9 wherein said tabletop organizer is made from a substantially clear material.

16. The invention of claim 15 wherein the substantially clear material is constructed of light permeable plastic.

17. The invention of claim 7 wherein said substantially clear material is constructed of glass.

18. The invention of claim 15 wherein said substantially clear material is constructed of glass.

* * * * *